US006474763B1

(12) United States Patent
Murakami et al.

(10) Patent No.: US 6,474,763 B1
(45) Date of Patent: Nov. 5, 2002

(54) LIQUID-DISCHARGE CONTROL METHOD, AND LIQUID DISCHARGING APPARATUS

(75) Inventors: Shuichi Murakami, Kawasaki; Masayoshi Tachihara, Chofu; Ken Tsuchii, Sagamihara; Toshiharu Inui, Yokohama; Mitsuhiro Ono; Kazuhiko Okito, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/514,186

(22) Filed: Feb. 28, 2000

(30) Foreign Application Priority Data

Mar. 1, 1999 (JP) ..... 11-053381

(51) Int. Cl.[7] ..... B41J 2/01
(52) U.S. Cl. ..... 347/14; 347/10; 347/60
(58) Field of Search ..... 347/11, 14, 17, 347/10, 60

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/650 |
| 4,723,129 A | | 2/1988 | Endo et al. | 347/56 |
| 4,740,796 A | | 4/1988 | Endo et al. | 347/56 |
| 5,218,376 A | | 6/1993 | Asai | 347/61 |
| 5,300,968 A | * | 4/1994 | Hawkins | 347/14 |
| 5,838,340 A | * | 11/1998 | Shimoda | 347/14 |
| 5,905,511 A | * | 5/1999 | Watanabe et al. | 347/14 |
| 6,155,673 A | | 12/2000 | Nakajima et al. | 347/61 |

FOREIGN PATENT DOCUMENTS

| | | |
|---|---|---|
| JP | 59-123670 | 7/1984 |
| JP | 59-138461 | 8/1984 |
| JP | 11-188870 | 7/1999 |

OTHER PUBLICATIONS

U.S. application No. 09/220,688, filing date Dec. 23, 1998.
U.S. application No. 08/425,769, filing date Apr. 20, 1995.
U.S. application No. 08/099,396, filing date Jul. 30, 1993.

* cited by examiner

*Primary Examiner*—Craig A. Hallacher
(74) *Attorney, Agent, or Firm*—Fitzpatrick, Cella, Harper & Scinto

(57) ABSTRACT

A recording control method and a recording apparatus in which high accuracy in the position of a discharged liquid droplet is obtained irrespective of changes in the temperature of a recording head are provided. In a liquid discharging method in which a bubble is generated by supplying ink (a liquid) with thermal energy, and the generated bubble is caused to communicate with the atmospheric air, by controlling a driving signal so that a discharging state in which a part of the ink to be discharged falls even if the temperature of the recording head changes, the direction of ink discharge can be stabilized.

21 Claims, 16 Drawing Sheets

LIQUID-DISCHARGE CONTROL METHOD, AND LIQUID DISCHARGING APPARATUS

BACKGROUND OF THE INVENTION

1. Field of the Invention

The present invention relates to a liquid-discharge control method and a liquid discharging apparatus. More particularly, the invention relates to a liquid-discharge control method when discharging a liquid using a head according to a liquid discharging method utilizing the generation of a bubble by heat, and to a liquid discharging apparatus. The invention also relates to an ink-discharge control method when performing recording on a recording medium using ink as a liquid, and to an ink-jet recording apparatus.

2. Description of the Related Art

From among conventionally known ink-jet recording methods, a recording method (a bubble-jet recording method) has been widely known in which a bubble is generated by heating ink within one of ink discharging ports and a liquid channel communicating therewith (these two components will be hereinafter termed a "nozzle") by heating means, such as a heater or the like, and a fine ink droplet is discharged from the ink discharging port onto a recording medium by the function of the bubble, in order to form an image by consecutively discharging ink droplets from corresponding ink discharging ports in the same manner. This method has been applied to printers, copiers and the like.

Recording heads which adopt the bubble-jet recording method are suitable for high-speed recording and high-quality image recording, because it is easy to increase the number of nozzles mounted in the head (provision of multiple nozzles) and to provide high-density nozzles. Particularly, attempts to increase the recording speed of a printer, a copier or the like by providing multiple nozzles or increasing the driving frequency for the recording head are actively being tried. There are also attempts to realize high resolution by reducing the amount of droplets (the amount of discharge) of ink, and thereby to improve the quality of a recorded image to the high-quality level of photography.

In the bubble-jet recording, a recording method has been known in which, when performing recording by discharging ink from a discharging port by a bubble generated by heating the ink, the bubble is caused to communicate with the atmospheric air if the internal pressure of the bubble is negative (U.S. Pat. No. 5,218,376). According to this method, it is possible to prevent the generation of ink mist during ink splash or discharge, so that the recording medium or the inside of the apparatus is not stained with the ink. In addition, since ink between the generated bubble and the discharging port can be substantially entirely discharged and the amount of the discharged ink is determined by the shape of the nozzle and the position of the heater, it is possible to perform stable recording in which the amount of the discharged ink droplet is always constant.

In the conventional bubble-jet recording method, when the duty ratio of an image is high or the ambient temperature is high, the temperature of the recording head is raised, so that the discharging direction may slightly change.

FIGS. 11A through 13F are schematic diagrams illustrating manners in each of which an ink droplet is discharged from an ink discharging port of a recording head. The recording head adopts a recording method in which a bubble generated during recording is caused to communicate with the atmospheric air.

FIGS. 11A–11C are enlarged views of a nozzle of the recording head.

In FIGS. 11A–11C, there are shown an electrothermal transducer 31 for heating ink, an ink discharging port 32, an ink supply port 33, and a discharging-port plate 35. FIG. 11A is a side cross-sectional view of the ink discharging nozzle. FIG. 11B is a side cross-sectional view of the ink discharging nozzle shown in FIG. 11A as seen from a direction rotated by 90 degrees from the state shown in FIG. 11A. FIG. 11C is a top plan view of the ink discharging nozzle. Line 11A–11A' shown in FIG. 1C is a line of cutting plane for providing the side cross section shown in FIG. 11A. Line 11B–11B' shown in FIG. 11C is a line of cutting plane for providing the side cross sectional view shown in FIG. 11B.

FIGS. 12A–12C and 12D–12F are diagrams, each illustrating how ink is discharged in the ink discharging state of the present invention in which a bubble generated from the recording head discharges ink by communicating with the atmospheric air in a state of negative pressure, as seen from the direction shown in FIG. 11A.

FIGS. 12A–12C illustrate how the ink is discharged when the temperature of the recording head is high. FIGS. 12D–12F illustrate how the ink is discharged when the same energy (driving signal) as in the case shown in FIGS. 12A–12C is applied to the electrothermal transducer in a state in which the temperature of the recording head is close to the room temperature.

As can be understood from FIGS. 12A–12F, the generated bubble is larger when the temperature is high than when the temperature is close to the room temperature, and the direction of ink discharge slightly changes depending on the difference between the temperatures of the recording head. It is considered that this is because the amount of ink slightly remaining in the vicinity of the ink discharging port differs depending on the size of the generated bubble, and a portion where the rear end of the ink leaves the ink discharging port differs depending on the difference in the amount of ink remaining in the vicinity of the ink discharging port.

That is, in FIG. 12B, consider the amounts of ink remaining at portions n and m, each surrounded by a circle. When the temperature of the recording head is high and therefore the size of the generated bubble is large, the amount of ink remaining at portion m is small, and as shown in FIG. 12C, the direction of the ink droplet discharged from ink remaining at portion n opposite to portion m of the ink discharging port slightly deviates from the center of the ink discharging port (indicated by a broken line in FIG. 12C). On the other hand, when the temperature of the recording head is low and therefore the size of the generated bubble is small, although a bubble tends to be generated slightly toward the ink supply port, this tendency is small, and, as shown in FIG. 12F, ink is discharged substantially rectilinearly along the center line of the ink discharging port.

In the case of the conventional recording head in which a bubble does not communicate with the atmospheric air, when the discharged ink droplet is separated from ink within the nozzle, the influence of the separated ink remaining in the vicinity of the ink discharging port does not cause any particular problem, because the ink returns to the inside of the nozzle. However, in the recording head having the above-described configuration in which a bubble generated by driving the electrothermal transducer is caused to communicate with the atmospheric air, the above-described phenomenon that, when the temperature of the recording head is high, the portion where an ink droplet is separated during ink discharge is in the vicinity of the inner wall of the ink discharging port and the discharging direction deviates, as shown in FIG. 12B, is observed.

FIGS. 13A–13C, and 13D–13F are diagrams, each illustrating how ink is discharged from the same viewpoint as shown in FIG. 11B, in order to illustrate the state of ink discharge shown in FIGS. 12A–12F in further detail.

As in the case of FIGS. 12A–12C, FIGS. 13A–13C illustrate how the ink is discharged when the temperature of the recording head is high. FIGS. 13D–13F illustrate how the ink is discharged when the same energy (driving signal) as in the case shown in FIGS. 13A–13C is applied to the electrothermal transducer in a state in which the temperature of the recording head is close to the room temperature.

As can be understood from FIGS. 13A–13C, when the temperature of the recording head is high, the generated bubble is large, and asymmetrical with respect to the center of the ink discharging port. Accordingly, as shown in FIG. 13A, a difference tends to occur between the velocity vectors P and Q of the ink due to the growth of the bubble, and a difference in the amount of ink remaining in the inner wall of the ink discharging port tends to occur between portions S and T. As a result, deviation in the discharging direction occurs.

On the other hand, when the temperature of the recording head is close to the room temperature, the generated bubble is small, and relatively symmetrical with respect to the center of the ink discharging port. Accordingly, as shown in FIG. 13D, a difference is hardly produced between the velocity vectors P and Q of the ink due to the growth of the bubble, and as shown in FIGS. 13E and 13F, the ink discharging direction is rectilinear along the center line of the ink discharging port (as indicated by a broken line shown in FIG. 13F) on an average.

As studied above, in the conventional head in which a bubble communicates with the atmospheric air in a state of negative pressure, the ink discharging direction tends to deviate when the temperature of the head is raised. As a result, the position where the ink droplet adheres on a recording sheet deviates, thereby causing problems to be solved such that white stripes are produced on the recorded image, or unevenness in density is produced due to overlap of recorded dots.

An undisclosed technique relating to the present invention will now be described.

As a result of further detailed studies about the relationship between the manner of ink discharge and input energy in a recording head in which a bubble communicates with the atmospheric air during ink discharge, the phenomenon that a part of the discharged ink droplet falls onto the electrothermal transducer (see FIG. 14C) is observed. Recent detailed studies have shown that this phenomenon of falling of the ink droplet during ink discharge occurs when the power of bubble generation is smaller than the power of bubble generation during ink discharge in which the bubble communicates with the atmospheric air, as in the above-described cases shown in FIGS. 12D–12F and FIGS. 13D–13F, at the same head temperature.

That is, according to the recent knowledge of the assignee of the present application, even in an ink discharge method in which ink is discharged by causing the bubble to communicate with the atmospheric air when the inner pressure of the bubble is negative, when input energy to the electrothermal transducer is high and the power of bubble generation is high, as can be understood from FIGS. 12D–12F and FIGS. 13D–13F, a discharging state in which the liquid droplet is disconnected from the liquid remaining in the vicinity of the discharging port at a position near the end portion of the discharging port is provided. On the other hand, when input energy to the electrothermal transducer is low and the power of bubble generation is relatively low, a discharging state in which the liquid droplet is disconnected from the liquid falling onto the electrothermal transducer in the vicinity of the center line of the discharging port occurs, as shown in FIGS. 14A–14C.

The term "fall" of the liquid or ink used in this specification indicates not only dropping of the liquid or ink in the direction of gravity, but also the movement and adherence of a part of the liquid or ink to be discharged, onto the surface of the substrate where the electrothermal transducer is provided, irrespective of the direction of the head.

Even in the discharging method having such a phenomenon of fall, the discharged ink droplet has an appropriate discharging speed, for example, 10–25 m/sec, which is sufficient as the discharging speed. Hence, the possibility that an ink droplet having an extremely high discharging speed is produced as in the case of ink discharge in which the phenomenon of fall does not occur is not present, and rebound of an ink droplet from the recording medium (the generation of mist) hardly occurs.

Furthermore, since the disconnection of the liquid does not occur in the vicinity of the end portion of the discharging port, deviation of the discharging direction of the droplet, which occurs at random when the phenomenon of fall is not present, hardly occurs.

Even if the phenomenon of fall occurs, this phenomenon does not influence the ink discharging speed. Hence, in ink discharge in which the bubble communicates with the atmospheric air, it is desirable to perform ink discharge by stably producing the phenomenon of fall, from the viewpoint of stabilization of the discharging direction of the droplet and suppression of the generation of mist.

However, even when adjusting the energy (the driving signal) supplied to the electrothermal transducer so that the ink droplet falls during ink discharge at the room temperature, the phenomenon of fall may not occur, in some cases, as shown in FIGS. 13D–13F because the energy of bubble generation increases although the same energy is supplied to the electrothermal transducer, if the head temperature is raised. In such a case, the position where the droplet is disconnected during ink discharge differs as described above, so that the ink discharging direction is not constant. As a result, the position where the ink droplet adheres to the recording medium deviates, thereby causing the generation of white stripes on the recorded image or the generation of unevenness in density due to differences in the overlapped positions of recorded dots. These phenomena may cause degradation in the quality of the recorded image.

FIGS. 15A and 15B are enlarged diagrams, each illustrating a longitudinal line recorded by a recording head having two columns of ink discharging nozzles. When recording a desired image by the recording head having such a configuration, since two columns of nozzles are present, recording is usually controlled so that ink is discharged by providing a time difference between the two columns of nozzles. In order to facilitate the following description, one column of nozzles is termed a column A, and another column of nozzles is termed a column B.

In each of the nozzle columns A and B, nozzles are arranged with a density of 300 dots per inch (300 dpi), and the columns A and B are arranged in a state of being shifted by 1/600 inch in the direction of the columns with each other. The interval between the columns A and B is 1/600 inch×5 (for 5 pixels of 600 dpi). When driving such a recording head with a driving frequency of 10 kHz, a time difference for recording 5 pixels of 600 dpi may be provided between the discharging timings for the nozzle columns A and B. This value equals 100×5 μsec. Thus, as shown in FIG. 15A, when a one-dot longitudinal line is recorded, respective dots are arranged along the longitudinal line.

FIG. 15B illustrates the positions of discharged dots when the discharging direction has slightly changed due to a change in the temperature of the recording head. Since the nozzle columns A and B are in a symmetrical positional relationship, a change in the ink discharging direction is enhanced. When the ink discharging direction has changed in the above-described manner, the recorded image is disturbed. Particularly when performing high-resolution recording, it is necessary to control the ink discharging position with higher accuracy.

When the positions of adherence of discharged dots on the recording medium deviate as a result of changes in the ink discharging direction as shown in FIG. 15B, a texture may be produced in a pattern representing halftone. Usually, an error diffusion method, a dither method or the like is used as the method for representing pseudo-halftone. It is considered that the above-described texture is produced by synchronism of a specific pattern used in the above-described method with deviation in the positions of recorded dots. The generation of such texture also causes degradation in the picture quality.

SUMMARY OF THE INVENTION

The present invention has been made in consideration of the above-described conventional approach and undisclosed technique.

It is an object of the present invention to provide a recording control method and a recording apparatus in which very accurate recording positions can always be obtained irrespective of changes in the temperature of a recording head.

According to one aspect of the present invention, a liquid-discharge control method, in which a bubble is generated by supplying a liquid with thermal energy by driving one of electrothermal transducers, and the liquid is discharged from a corresponding one of nozzles by causing the bubble to communicate with the atmospheric air, includes a detection step of detecting a temperature of a head where the electrothermal transducers and the nozzles are provided, an adjusting step of adjusting a width of a driving signal for driving the electrothermal transducer so that a part of the discharged liquid falls onto a side where the electrothermal transducer is provided, based on the temperature detected in the detection step, and a recording step of discharging the liquid by driving the head using the driving signal having the adjusted width adjusted in the adjusting step.

According to another aspect of the present invention, a liquid discharging apparatus including a head, which includes electrothermal transducers, each for generating a bubble by supplying a liquid with thermal energy, and nozzles for discharging the liquid, for causing the bubble to discharge the liquid by causing the generated bubble to communicate with the atmospheric air, includes detection means for detecting a temperature of the head, adjustment means for adjusting a width of a driving signal for driving one of the electrothermal transducers so that a part of the discharged liquid falls onto a side where the electrothermal transducer is provided, based on the temperature detected by the detection means, and recording means for discharging the liquid by driving the head using the driving signal having the adjusted width adjusted by the adjustment means.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

A first preferred embodiment of the present invention will now be described in detail with reference to the drawings.

Although in the following description, an ink-jet recording method in which ink is used as a liquid is illustrated, the present invention may also be applied to a discharging method and apparatus other than for recording in which a liquid other than ink is used.

Outline of the Main Body of the Apparatus

Figure 1:
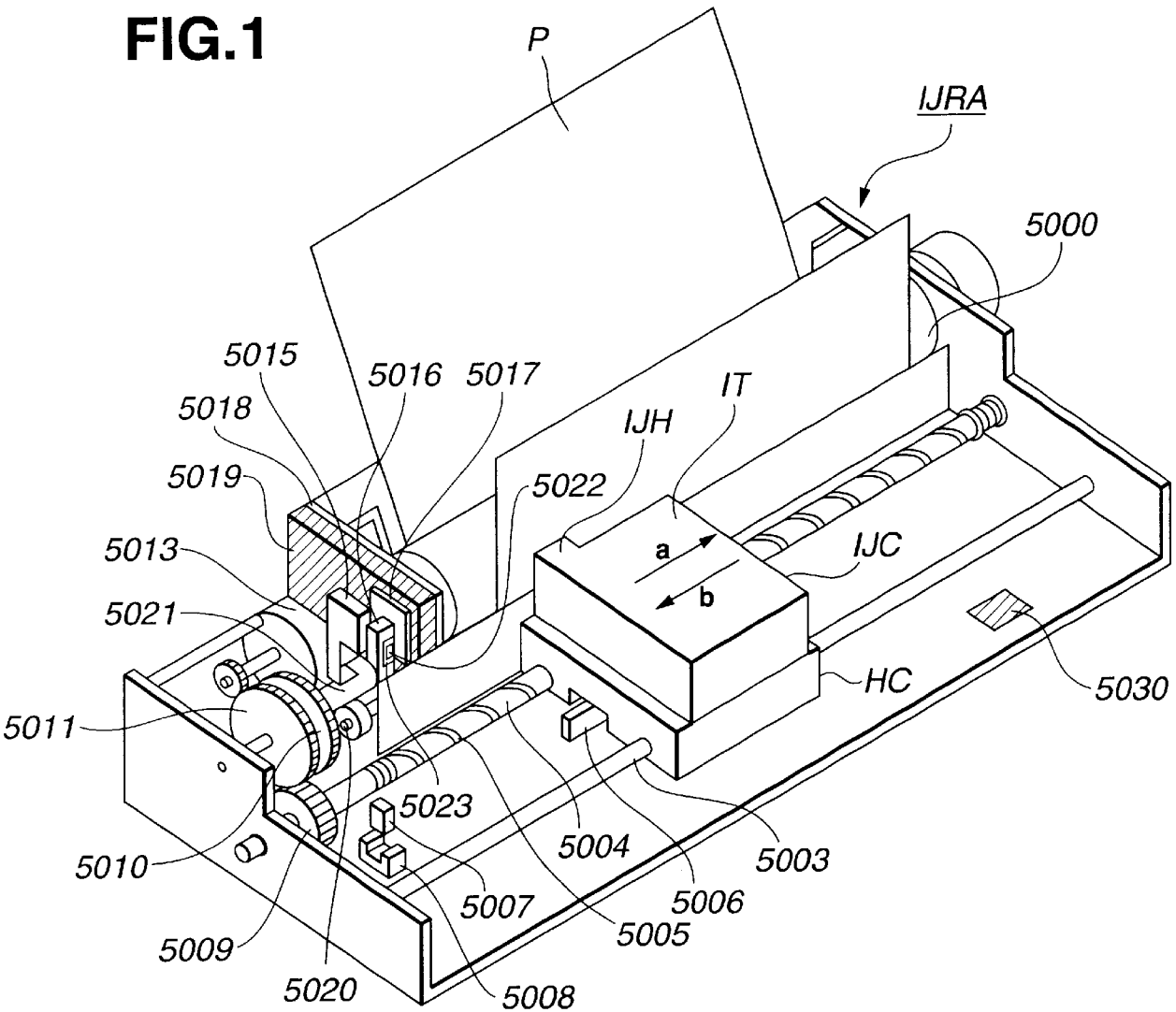
FIG. 1 is a schematic perspective view illustrating an external appearance of the configuration of an ink-jet printer IJRA according to a first embodiment of the present invention.

FIG. 1 is a schematic perspective view illustrating an external appearance of the configuration of an ink-jet printer or recording apparatus IJRA according to the first embodiment. In FIG. 1, a carriage HC engaged with a screw groove 5005 of a lead screw 5004 which is rotated via driving-force transmission gears 5009–5011 in a state of being linked with the forward-reverse revolution of a driving motor 5013 has a pin (not shown), and is reciprocated in the directions of arrows a and b while being supported by a guide rail 5003. An integrated ink-jet cartridge IJC which incorporates a recording head IJH and an ink tank IT is mounted on the carriage HC. A sheet pressing plate 5002 presses a recording medium, such as recording paper P, against a platen 5000 over the entire range of movement of the carriage HC. A photocoupler 5007, 5008 is a home-position detector for performing, for example, switching of the direction of revolution of the driving motor 5013 by confirming the presence of a lever 5006 of the carriage HC within the above-described range. A member 5016 supports a cap member 5022 for capping the front surface of the recording head IJH. A suction unit 5015 sucks the inside of the capped portion, in order to perform suction recovery of the recording head IJH via an opening 5023 in the capped portion. Reference numeral 5017 represents a cleaning blade. A member 5019 allows the movement of the cleaning blade 5017 in the forward and reverse directions. These members are supported on a supporting plate 5018 provided on the main body of the apparatus.

A well-known cleaning blade may, of course, be used as this cleaning blade. A lever 5021 starts suction for suction recovery, and is moved in accordance with the movement of a cam 5020 which is engaged with the carriage HC. A driving force from the driving motor 5013 is used for this movement via a known transmission mechanism, such as clutch switching or the like.

Each of these capping, cleaning and suction recovery is configured so that desired processing can be performed at a corresponding position by the operation of the lead screw 5005 when the carriage HC reaches a region at the home position side, and can be applied to the first embodiment provided that a desired operation is performed at a well-known timing.

Configuration of Control

The configuration of control for executing control of the above-described apparatus will now be described.

Figure 2:
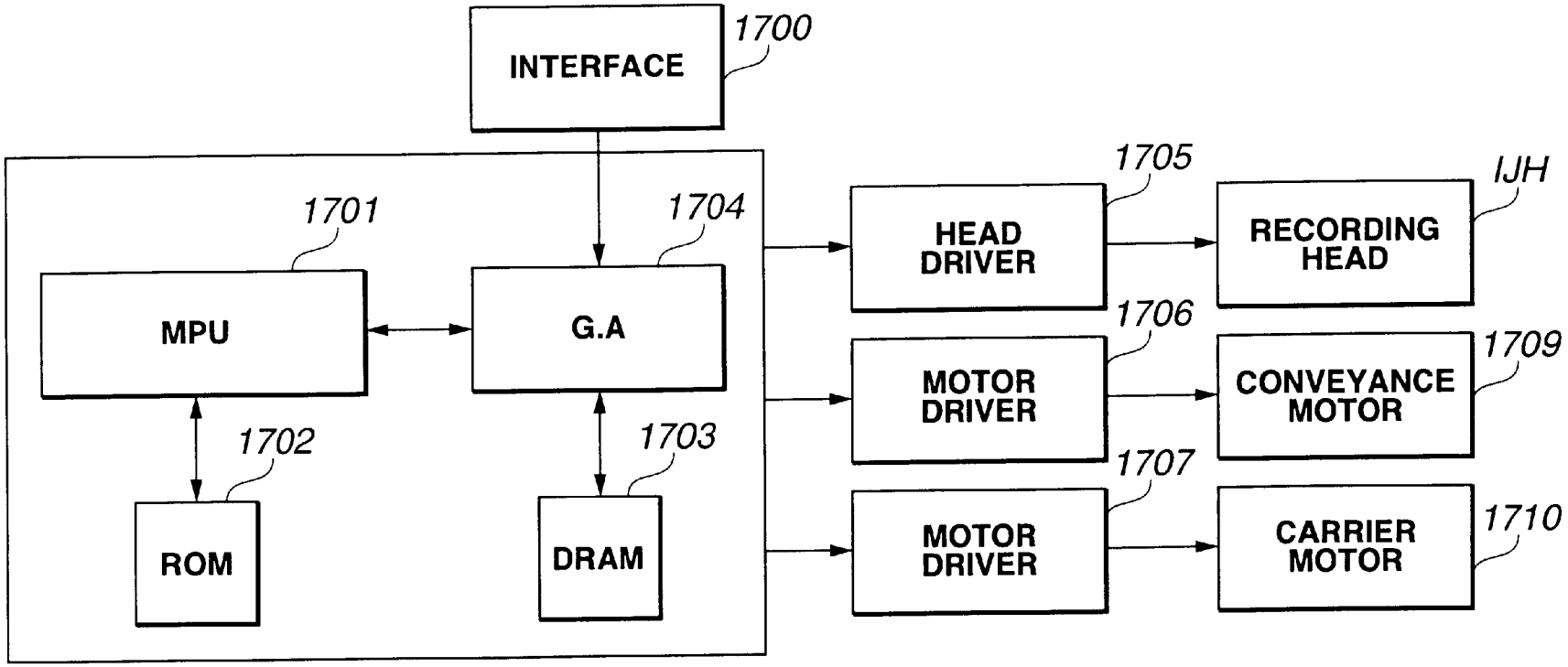
FIG. 2 is a block diagram illustrating the configuration of a control circuit for the ink-jet printer IJRA shown in FIG. 1.

FIG. 2 is a block diagram illustrating the configuration of a control circuit for the ink-jet printer IJRA. In FIG. 2, there are shown an interface 1700 for inputting recording signals, an MPU (microprocessor unit) 1701, a ROM (read-only memory) 1702 storing control programs to be executed by the MPU 1701, and a DRAM (dynamic random access memory) 1703 for storing various data (the above-described recording signals, recording data to be supplied to the recording head IJH, and the like). A gate array (G.A.) 1704 controls supply of recording data to the recording head IJH, as well as data transfer with the interface 1700, the MPU 1701 and the RAM 1703. There are also shown a carrier motor 1710 for moving the recording head IJH, and a conveyance motor 1709 for conveying recording sheets. A head driver 1705 drives the recording head IJH. Motor drivers 1706 and 1707 drive the conveyance motor 1709 and the carrier motor 1710, respectively. A temperature sensor 5030 detects the temperature within the apparatus.

The operation of the above-described configuration of control will now be described. When a recording signal has input to the interface 1700, the recording signal is converted into recording data for printing by the gate array 1704 and the MPU 1701. Recording is performed by driving the motor drivers 1706 and 1707, and driving the recording head IJH in accordance with data transmitted to the head driver 1705.

Although the ink tank IT and the recording head IJH may be integrally formed to provide the exchangeable ink cartridge IJC as described above, the ink tank IT and the recording head IJH may be separately formed, so that only the ink tank IT can be exchanged when ink is used up.

Figure 3:
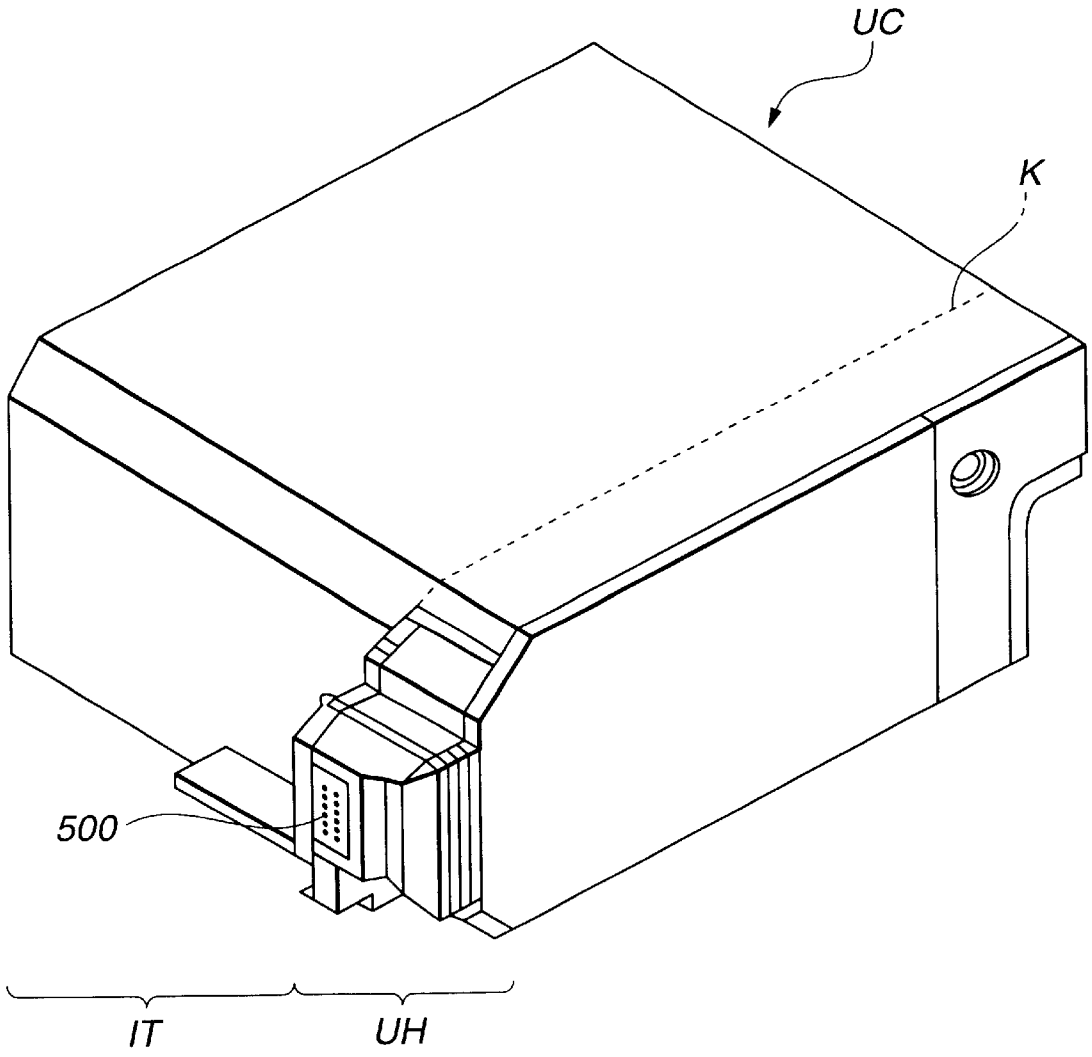
FIG. 3 is a schematic perspective view illustrating an external appearance of an ink cartridge IJC in which an ink tank and a head are separable.

FIG. 3 is a perspective view illustrating an external appearance of the ink cartridge IJC in which the ink tank IT and the recording head IJH can be separated from each other. As shown in FIG. 3, the ink tank IT and the recording head IJH can be separated from each other at the position of a border line K. Electrodes (now shown) for receiving an electrical signal supplied from the carriage HC when the ink cartridge IJC is mounted in the carriage HC are provided on the ink cartridge IJC. According to this electrical signal, the recording head IJH is driven in the above-described manner, to discharge ink.

In FIG. 3, reference numeral 500 indicates columns of ink discharging ports. A fibrous or porous ink absorbing member for holding ink is provided in the ink tank IT, and ink is held by the ink absorbing member. As shown in FIG. 3, two columns of ink discharging ports are provided with a predetermined distance in the recording head IJH.

Figure 4:
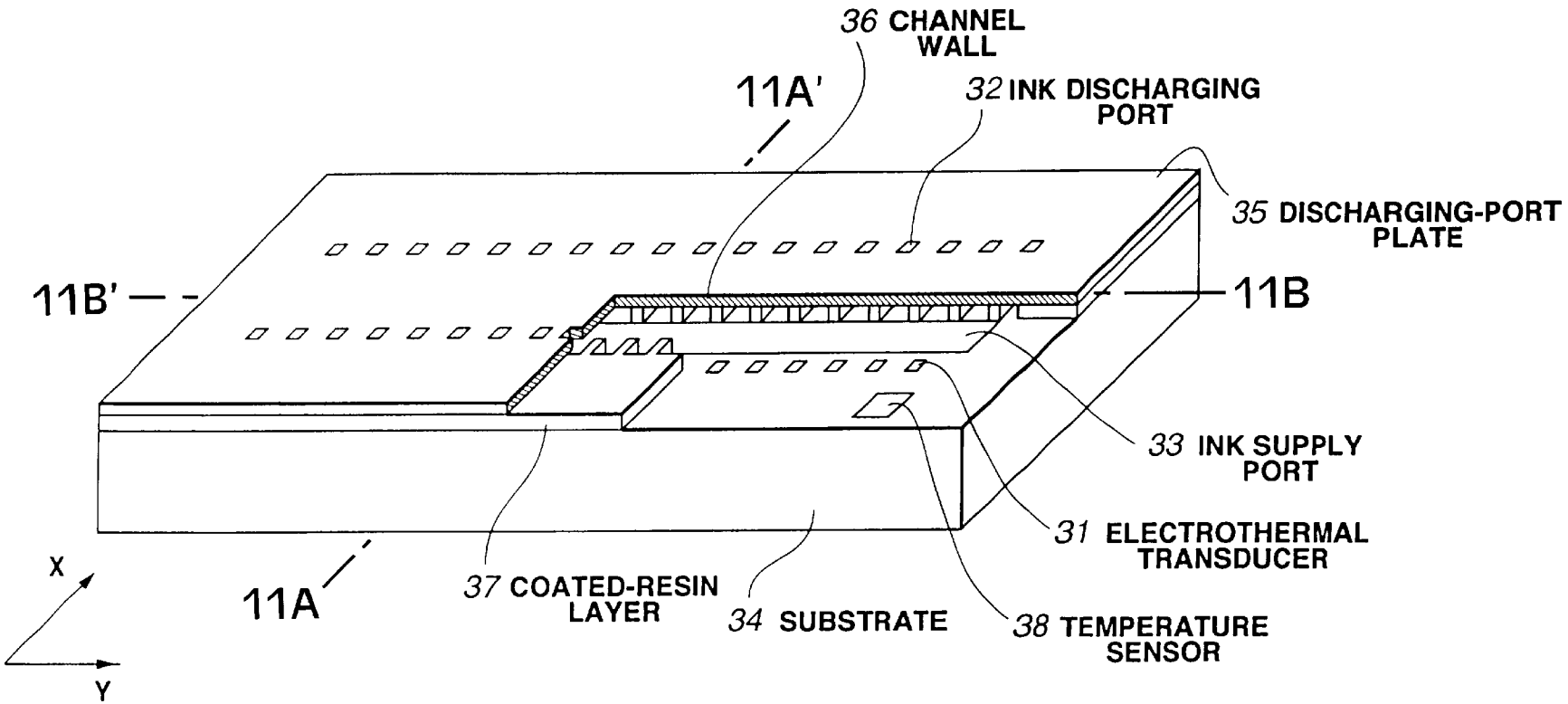
FIG. 4 is a partially broken perspective view illustrating the structure of a portion near ink discharging ports of a recording head IJH.
Figure 5:
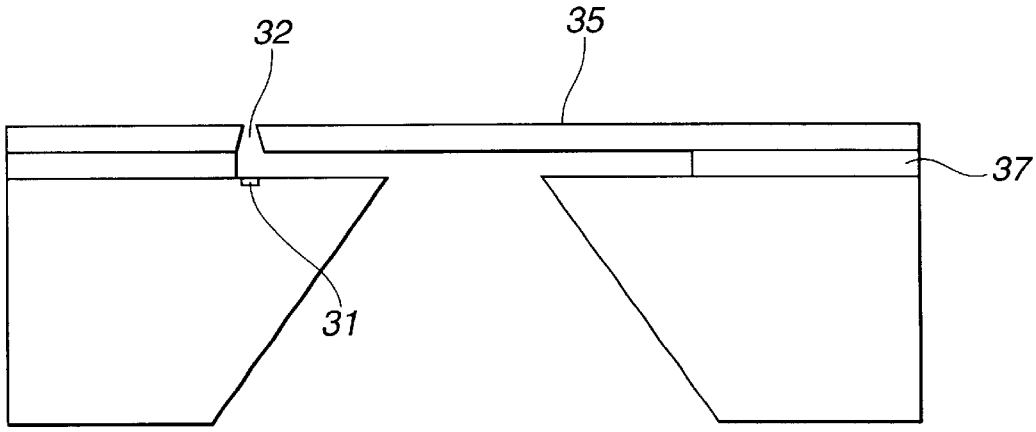
FIG. 5 is a cross-sectional view illustrating the structure of one of the ink discharging ports of the recording head IJH.

FIG. 4 is a partially broken perspective view illustrating the configuration of a portion near the ink discharging ports of the recording head IJH. FIG. 5 is a cross-sectional view illustrating the structure of one of the ink discharging ports of the recording head IJH. In order to facilitate description, electrical interconnection for driving the electrothermal transducer, and the like are not shown in FIGS. 4 and 5.

In FIGS. 4 and 5, there are shown electrothermal transducers (heaters) 31 for heating ink, ink discharging ports 32, a component substrate (also merely called a "substrate") 34, an ink supply port 33 for ink supplied from the ink tank IT, an discharging-port plate 35 where the ink discharging ports 32 are provided, an ink-channel wall 36 for forming an ink channel for each of the ink discharging ports 32, and a coated-resin layer 37.

The component substrate 34 is made of a material, such as glass, ceramics, plastics, metal or the like, and operates as a part of a member constituting ink channels. The component substrate 34 can also operate as a supporting member for the electrothermal transducers 31, and the ink-channel wall 36 for forming the ink channels and the ink discharging ports. In the first embodiment, the component substrate 34 comprises a silicon (Si) substrate (wafer).

As shown in FIG. 4, the ink-channel wall 36 for forming the ink channels is provided on the component substrate 34. The discharging-port plate 35 including ink discharging ports 32 is provide above the ink-channel wall 36. Although in FIG. 4, the ink-channel wall 36 and the discharging-port plate 35 are indicated as separate members, it is also possible to simultaneously form the ink-channel wall 36 and the discharging-port plate 35 as an integrated member by forming the ink-channel wall 36 on the component substrate 34 according to a method, such as spin coating or the like.

In the first embodiment, by making the distance from the electrothermal transducer 31 to the distal end of the ink discharging port 32 as short as 23 $\mu$m, a structure in which a bubble generated by driving the electrothermal transducer 31 is caused to communicate with the atmospheric air is obtained. The electrothermal transducer 31 has the shape of a square having a size of 32 μm×32 μm. A diode (Di) temperature sensor 38 is provided on the component substrate 34 for detecting the temperature of the recording head IJH.

The electrothermal transducers 31 and the ink supply port 33 are also provided on the component substrate 34. As shown in FIG. 4, two electrothermal-transducer columns, each including 32 electrothermal transducers 31, are arranged in a staggered state at both sides of the ink supply port 33, comprising a groove-shaped threaded opening, with a pitch of 300 dpi (in the Y direction shown in FIG. 4). The interval between these two columns (in the X direction shown in FIG. 4) equals an interval for 7 pixels with 600 dpi, i.e., 296 μm.

In recording control, in order to discriminate between these two electrothermal-transducer columns, one of the two columns is termed an even column, and another column is termed an odd column.

The power supply voltage for the recording apparatus IJRA is 10.3 V, and the driving frequency for the recording head IJH is 10 kHz.

In the first embodiment, driving control is performed by supplying the electrothermal transducer 31 of the recording head IJH having the above-described configuration with a double-pulse driving signal as the driving signal.

Figure 6:
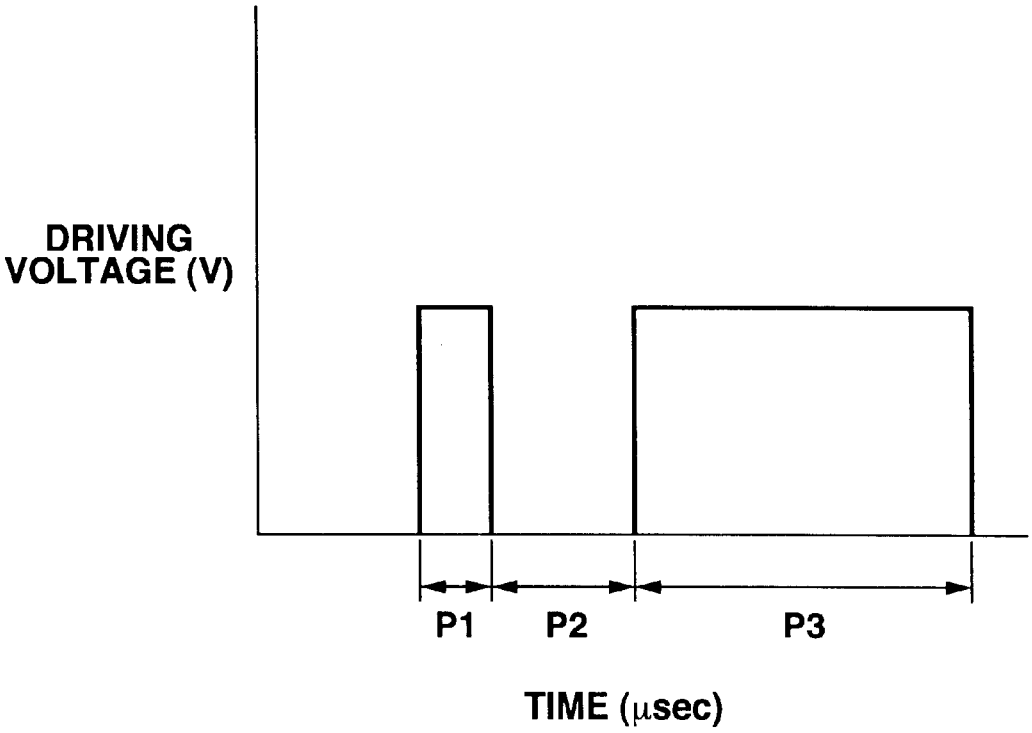
FIG. 6 is a graph illustrating the waveforms of typical double pulses.

FIG. 6 is a graph illustrating the waveforms of typical double pulses.

In FIG. 6, P1 represents a pre-pulse, which operates for raising the temperature of ink near the electrothermal transducer to a degree of not generating a bubble, and P1 represents a main pulse, which operates for raising the temperature of the ink to a temperature for generating a bubble in order to discharge the ink from the corresponding ink discharging port. P2 represents a period in which a pulse is absent. By thus providing a plurality of driving pulses (double pulses in this case) for one ink discharging operation, it is possible to increase a force to generate a bubble. Furthermore, by controlling the width of the pre-pulse and the period of pause of a pulse, it is possible to easily control the quantity of heat supplied to ink and the power of bubble generation.

Figure 7:
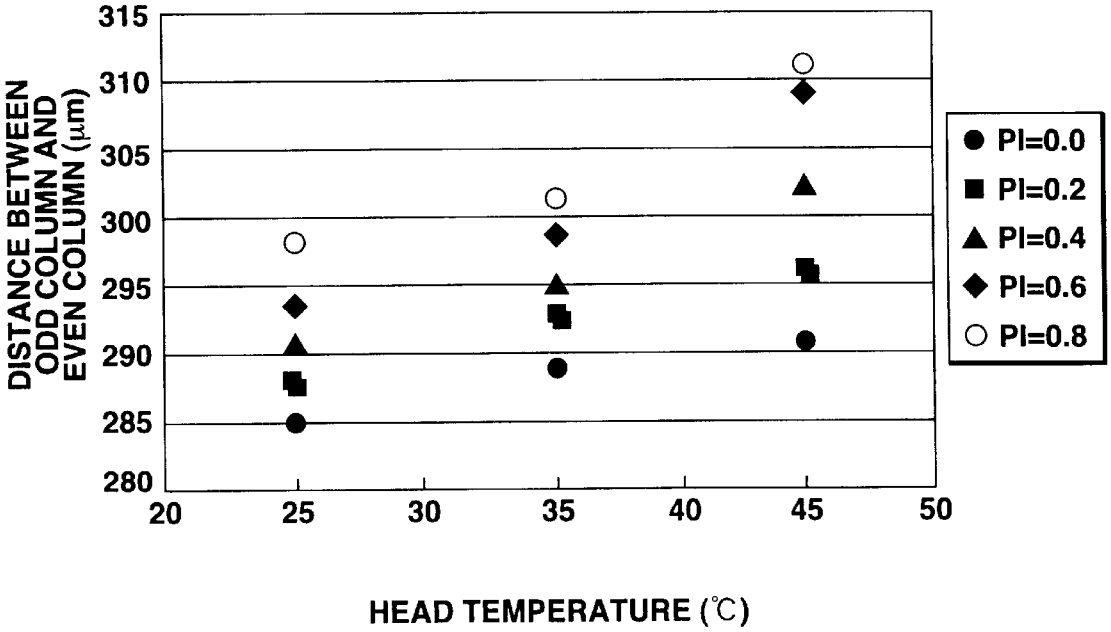
FIG. 7 is a diagram illustrating changes in the distance between an odd column and an even column due to changes in the head temperature.

FIG. 7 is a diagram illustrating changes in the distance between the odd column and the even column when the head temperature changes. The studies of the inventors have shown that such changes occur. Changes in the distance between the odd column and the even column as a result of changes in the temperature shown in FIG. 7 are obtained by changing the driving condition for the pre-pulse P1 within a range of 0.0–0.8 psec with an interval of 0.2 μsec.

Accordingly, in order to make the distance between the odd column and the even column constant to a value of 296 μsec, it is necessary to change the width of the driving pulse P1 in accordance with the head temperature.

In the present invention, in a driving state in which a liquid is discharged by causing the generated bubble to communicate with the atmospheric air, and a part of the discharged liquid falls onto the side of the component substrate (onto the electrothermal transducer) where the electrothermal transducers are provided, instability in the discharging direction because the phenomenon of fall does not occur as a result of a change in the head temperature is prevented by a driving signal. The relationship between the phenomenon of fall and the driving signal will now be described.

Observation of the Phenomenon of Fall

Figure 16:
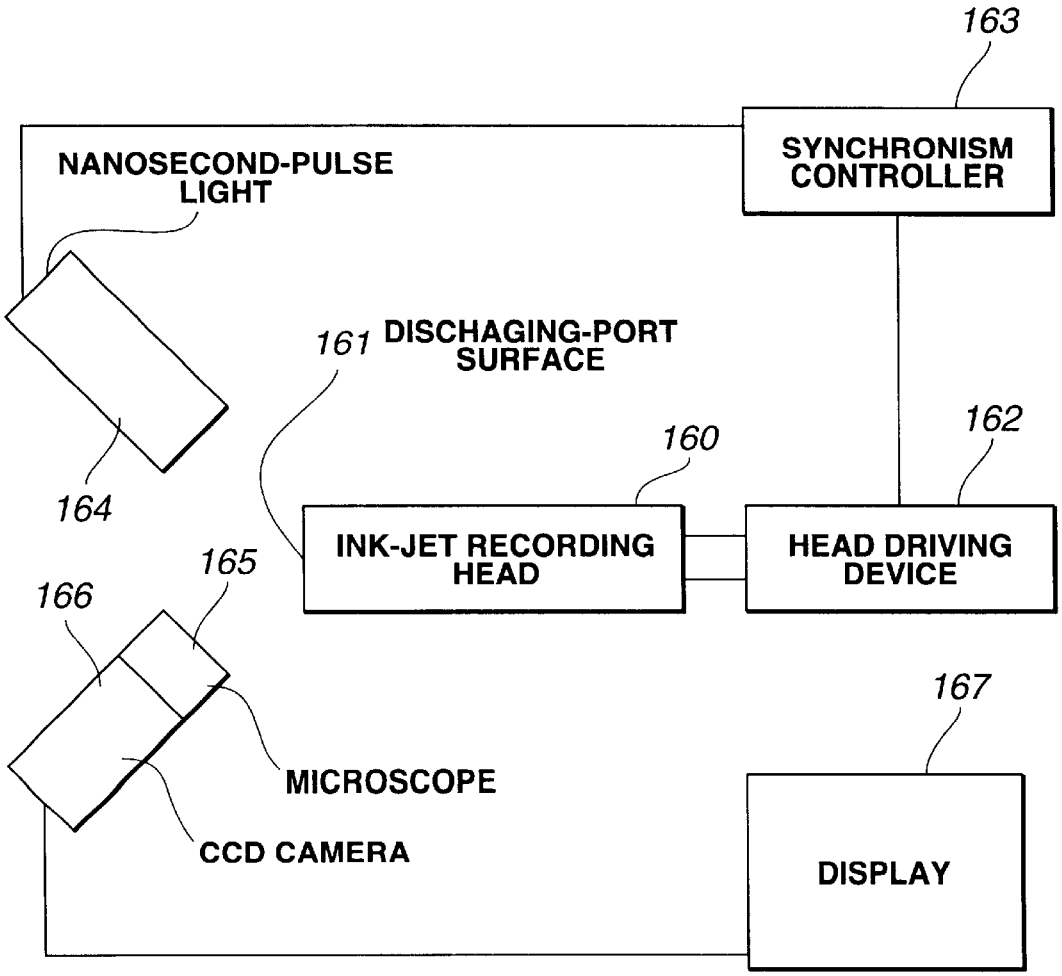
FIG. 16 is a diagram illustrating a system for observing the phenomenon of fall.

FIG. 16 illustrates the configuration of an observation apparatus for verifying whether or not the phenomenon of fall occurs.

In this apparatus, an ink-jet recording head 160 having the configuration shown in FIG. 4 is disposed. A head driving device 162 for supplying the electrothermal transducers of the ink-jet recording head 160 with a double-pulse driving signal is provided for the ink-jet recording head 160.

The head driving device 162 can change the pulse width of the driving signal to be supplied to the ink-jet recording head 160. Nanosecond-pulse light 164 illuminates a discharging-port surface 161 of the ink-jet recording head 160, and can perform nanosecond emission.

The nanosecond-pulse light is used in order to observe a discharging state within a unit time. A synchronism controller 163 for obtaining synchronism between the head driving device 162 and the nanosecond-pulse light 164 is connected between the head driving device 162 and the nanosecond-pulse light 164.

A microscope 165 and a CCD (charge-coupled device) camera 166 are provided in order to receive an observed image. The CCD camera 166 is connected to a display 167 for displaying the image.

The nanosecond-pulse light 164 is projected onto the discharging-port surface 161 of the ink-jet recording head 160 with a predetermined angle (for example, 45 degrees). A lens and the CCD camera 166 for receiving an image are disposed with an angle symmetrical to the predetermined angle with respect to the direction of the discharging-port surface 161, in order to receive reflected light.

By providing such a configuration in which a state at a portion near the discharging port is observed obliquely with respect to the discharging-port surface 161, a discharging state is observed at an interval equal to or less than 1 μsec. The inventors of the present invention performed observation at an interval of 0.5 μsec.

Figure 14A:
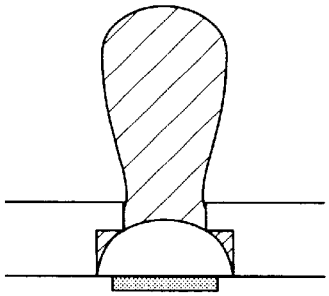
FIGS. 14A–14C are diagrams illustrating the phenomenon that a part of a discharged ink droplet falls onto an electrothermal transducer.
Figure 14B:
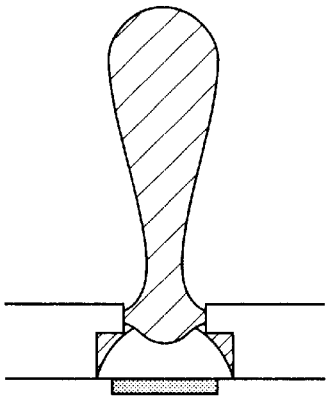
Figure 14C:
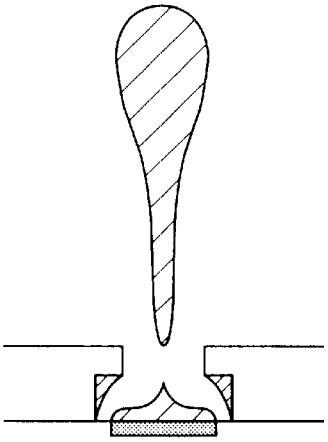
Figure 15A:
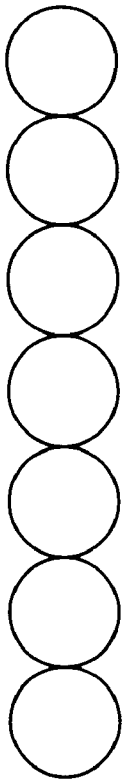
FIGS. 15A and 15B are enlarged views, each illustrating a longitudinal line recorded by a recording head which includes two columns of ink discharging nozzles.
Figure 15B:
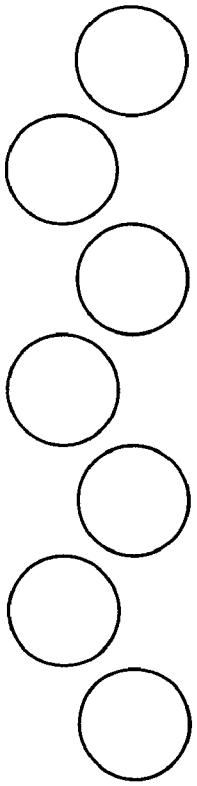

When ink is discharged in a state other than the state of fall, disconnection of ink is observed at a position along the circumference of the discharging port. On the other hand, when ink is discharged in the state of fall as shown in FIGS. 14A–14C, a state in which ink near the circumference of the discharging port falls from the discharging port toward the inside of the nozzle is observed. Accordingly, the two discharging states can be discriminated by such observation.

The observation was performed using the above-described double-pulse signal as the driving signal for the electrothermal transducer with a driving voltage of 10.3 V, and fixing the period of pause of the pulse P2 and the width of the main pulse P3 to 1.0 μsec and 1.8 μsec, respectively.

The ambient temperature was changed with five steps between 20° C. and 50° C. By changing the pre-pulse at each temperature, whether or not discharge in the state of fall is stably performed was observed.

Table 1 (for driving) illustrates the values of P1, P2 and P3 in double-pulse control performed in order to make the distance between the odd column and the even column constant to a value of 296 μm by maintaining stability in the ink discharging direction by stably performing discharge in the state of fall irrespective of changes in the temperature, based on the result of the above-described measurement.

TABLE 1

| Head temperature (T) | P1 | P2 | P3 |
|---|---|---|---|
| T ≦ 25° C. | 0.6 | 1.0 | 1.8 |
| 25° C. < T ≦ 30° C. | 0.5 | 1.0 | 1.8 |
| 30° C. < T ≦ 35° C. | 0.4 | 1.0 | 1.8 |
| 35° C. < T ≦ 40° C. | 0.3 | 1.0 | 1.8 |

TABLE 1-continued

| Head temperature (T) | P1 | P2 | P3 |
|---|---|---|---|
| 40° C. < T ≦ 45° C. | 0.2 | 1.0 | 1.8 |
| 45° C. < T | 0.1 | 1.0 | 1.8 |

Figure 8:
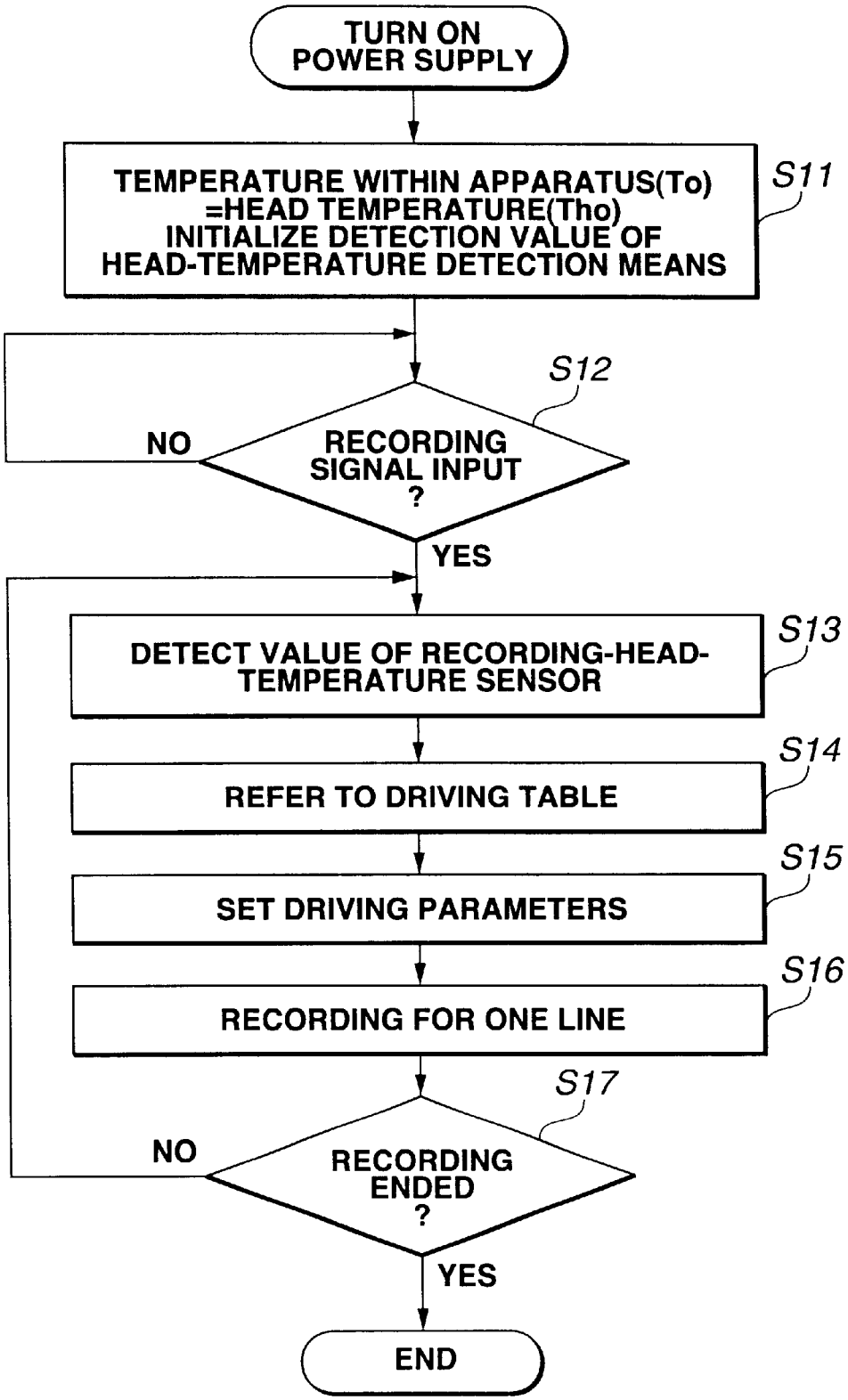
FIG. 8 is a flowchart illustrating recording control in which recording is performed by changing the width of a driving pulse (particularly a pre-pulse) in accordance with the temperature of the recording head.

Next, a description will be provided of recording control in which recording is performed by changing the width of the driving pulse (particularly the pre-pulse) in accordance with the temperature of the recording head, with reference to the flowchart shown in FIG. 8.

After turning on the power supply of the recording apparatus, first, in step S11, the temperature ($T_s$) within the apparatus is detected by a temperature detector (for example, a thermistor) 5030, and the detection value of the temperature sensor 38 for the recording head IJH comprising the Di sensor is initialized, because the Di sensor cannot measure the absolute value of the temperature at the initial state.

Then, in step S12, input of a recording signal is awaited. When a recording signal has been input, the process proceeds to step S13, where recording is started.

In the first embodiment, in order to perform control so as to change the width of the driving pulse to be applied to the recording head IJH at every scanning recording (for one line) of the recording head IJH, in step S13, the head temperature (T) is detected at the head of a line to be recorded. Then, in step S14, in order to change the width of the driving pulse so that a part of the discharged ink droplet is stably driven to fall onto the side of the electrothermal transducer, Table 1 for driving stored in the apparatus is referred to. In step S15, the pulse width obtained from Table 1 for driving is set as the width of the driving pulse to be applied to the recording head IJH. For example, when the head temperature is 35° C., setting of P1=0.4, P2=1.0, and P3=1.8 (sec) is performed in accordance with the values obtained from Table 1.

Then, in step S16, recording for one line is performed by performing scanning of the recording head IJH. Then, in step S17, it is determined if recording has ended. If the result of the determination in step S17 is negative, i.e., if a recording signal is still present and recording is to be continued, the process returns to step S13, and the above-described processing is repeated. If the result of the determination in step S17 is affirmative, the process is terminated.

According to the first embodiment, even if the temperature of the recording head is raised, by changing the width of the driving pulse used for driving each electrothermal transducer in accordance with each temperature, it is possible to perform ink discharge in which the fall of the ink droplet stably occurs at each temperature, reduce deviation in the discharging direction due to ink remaining on the inner wall of the discharging port, thereby perform exact recording, and achieve reduction of ink mist.

Accordingly, it is possible to make the distance between the odd column and the even column constant to a value of 296 μm.

As described above, in the present invention, when causing the bubble generated by driving the electrothermal transducer to communicate with the atmospheric air, driving conditions for double pulses are changed in accordance with the head temperature so as to maintain disconnection of ink at a portion near the ink discharging port constant, utilizing double-pulse control.

Although in the first embodiment, the driving pulse is changed at every recording for one line by the recording head, the present invention is not limited to such an approach. The timing of the change may be appropriately set in accordance with the situation, such that, for example, the driving pulse is changed while recording for one line is being performed by the recording head.

Although in the first embodiment, only the pre-pulse is changed, the same effects may be obtained by changing the period of pause of the pulse P2.

An increase in the width of the pre-pulse P1 or the width of the period of pause of the pulse P2 described in the first embodiment indicates an increase in the power of bubble generation. This is substantially equivalent to an increase in the power of bubble generation due to a rise in the head temperature. By thus changing the driving conditions in double-pulse control in accordance with the head temperature, it is possible to perform control so that a part of the discharged ink droplet falls onto the side of the electrothermal transducer, and to maintain disconnection of ink at the inner wall of the ink discharging port constant in order to prevent the problem in the conventional approach.

Accordingly, a state in the conventional approach in which the phenomenon of fall of the ink droplet changes in accordance with changes in the temperature of the recording head is prevented by changing the driving conditions in double-pulse control in accordance with the temperature of the recording head.

Other Embodiments

A description will now be provided of a second embodiment of the present invention in which a recording head having a configuration such that the distance form the electrothermal transducer to the distal end of the discharging port is increased to 25 μm, and the size of the electrothermal transducer is reduced to 30 μm×30 μm is used in the recording apparatus having the same configuration as that in the first embodiment. The structure of the recording head is the same as in the recording head IJH described in the first embodiment in other portions. A Di sensor for detecting the head temperature is provided on the substrate of the recoding head.

Figure 9:
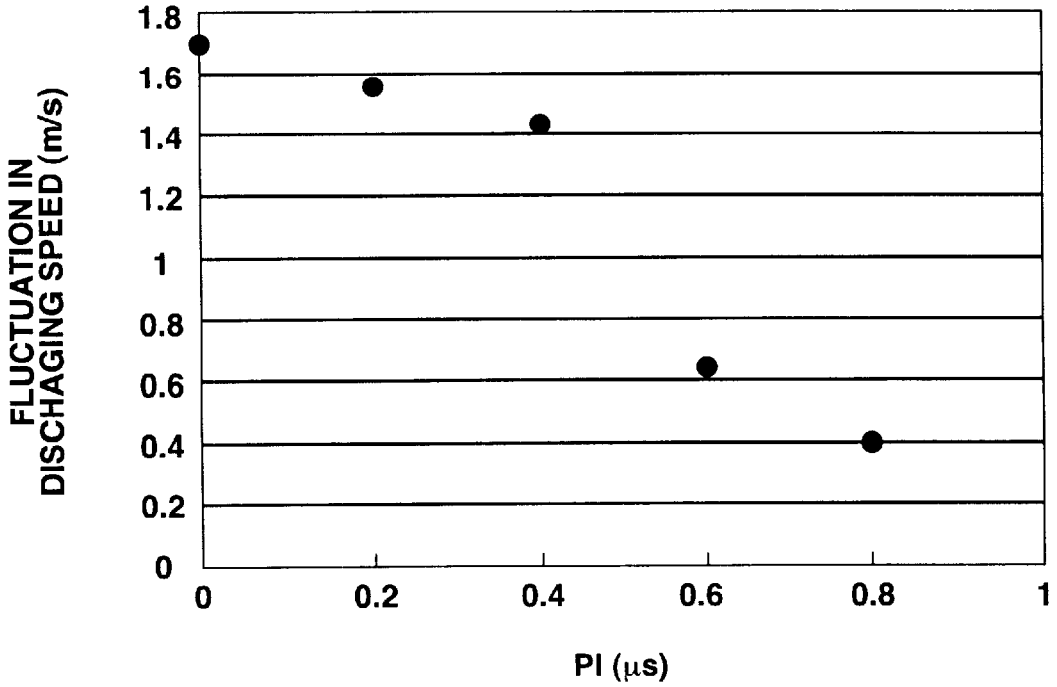
FIG. 9 is a diagram illustrating the relationship between the width of a pre-pulse (P1) and fluctuation in the ink discharging speed when using a recording head according to a second embodiment of the present invention.

FIG. 9 is a diagram illustrating the relationship between the width of the pre-pulse P1 and fluctuation in the ink discharging speed when the recording head having the above-described configuration is used.

As can be understood from FIG. 9, when P1=0.0 μsec, i.e., when applying one driving pulse for one ink discharging operation without applying a pre-pulse (application of only a main pulse), although fluctuation in the discharging speed is as large as 1.7 m/sec for an ink discharging speed of 16.5 m/sec, fluctuation in the discharging speed is reduced to about 0.6 m/sec for P1=0.6 μsec, indicating that ink discharge is stabilized.

It is considered that this is because by driving the recording head by providing a plurality of pulses for one ink discharging operation, energy which is insufficient with only the main pulse can be increased, so that it is possible to cause the bubble to stably communicate with the atmospheric air.

Figure 10:
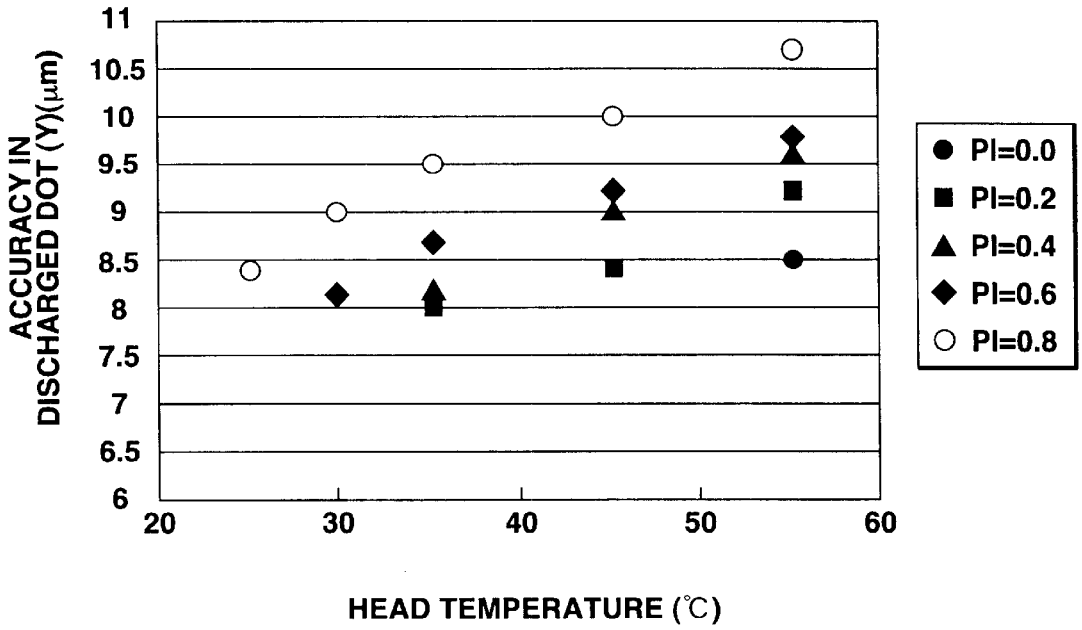
FIG. 10 is a diagram illustrating the results of measuring accuracy in the discharged dot in the Y direction shown in FIG. 4 as the function of the head temperature when changing the width of the pre-pulse within a range of 0.0–0.8 μsec.
Figure 11A:
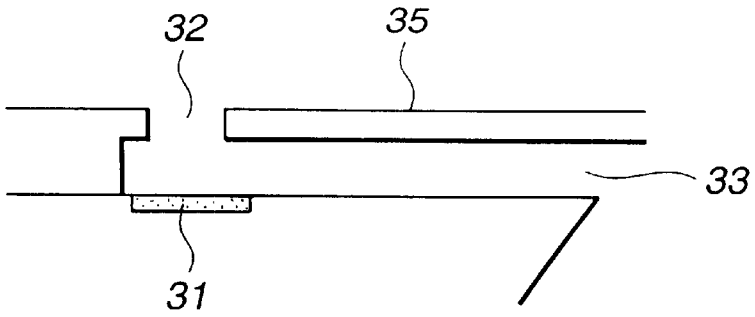
FIGS. 11A–11C are enlarged views of an ink discharging nozzle of the recording head.
Figure 11B:
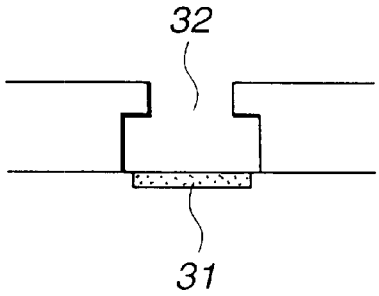
Figure 11C:
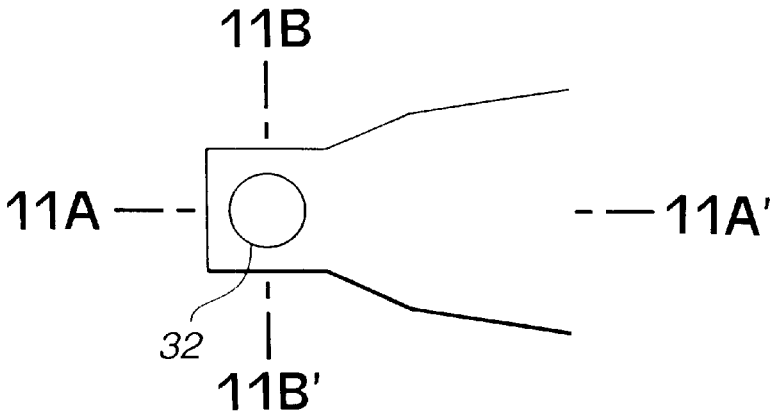
Figure 12A:
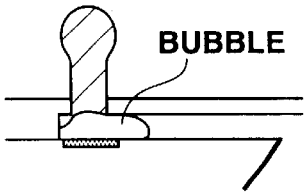
FIGS. 12A–12F are diagrams illustrating how the state of ink discharge from the recording head changes, as seen from the same viewpoint as that shown in FIG. 11A.
Figure 12D:
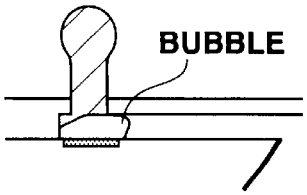
Figure 12B:
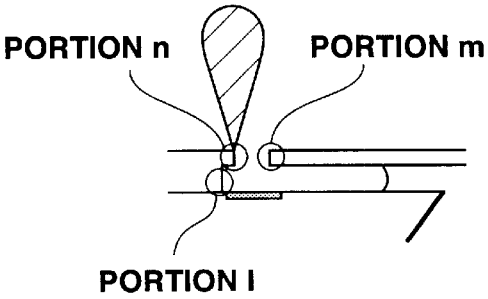
Figure 12E:
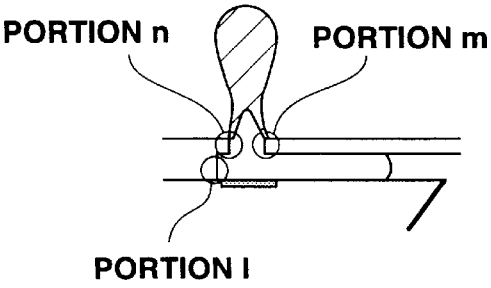
Figure 12C:
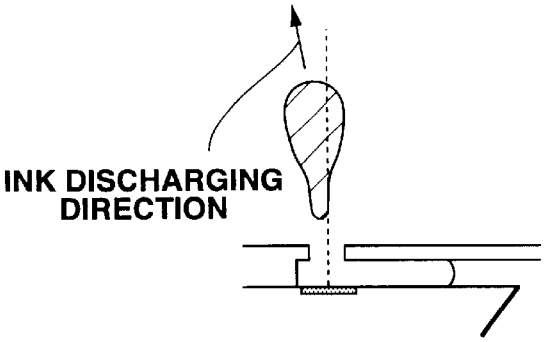
Figure 12F:
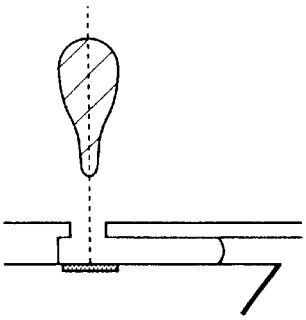
Figure 13A:
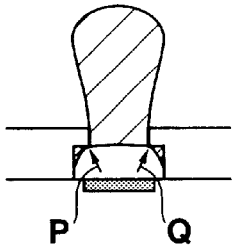
FIGS. 13A–13F are diagrams illustrating how the state of ink discharge from the recording head changes, as seen from the same viewpoint as that shown in FIG. 11B.
Figure 13D:
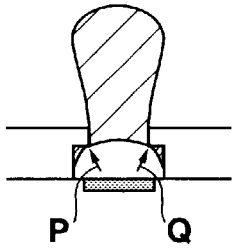
Figure 13B:
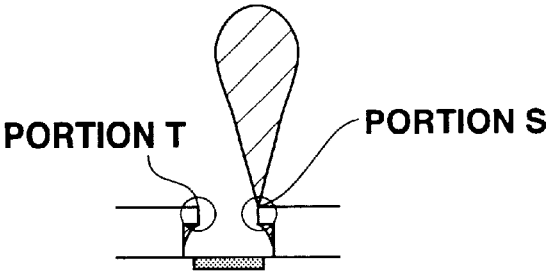
Figure 13E:
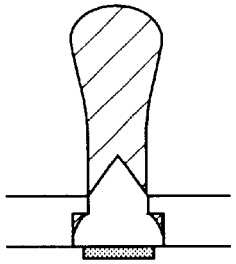
Figure 13C:
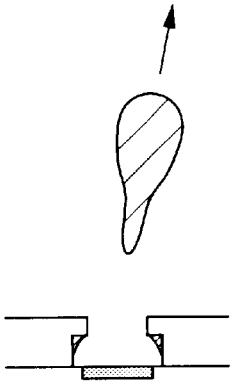
Figure 13F:
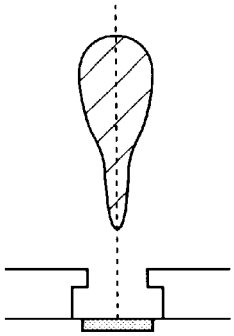

FIG. 10 is a diagram illustrating the results of measuring the relationship between accuracy in the discharged dot in the Y direction shown in FIG. 4 and the head temperature while changing the width of the pre-pulse P1 within a range of 0.0–0.8 μsec. In FIG. 10, data when the value of P1 is small when the head temperature is low are not shown, because measurement could not be performed due to instability of ink discharge.

Based on the results of measurement shown in FIG. 10, by executing recording control as shown in FIG. 8 in the first embodiment, and adjusting the width of the driving pulse to be applied to the recording head to values shown in the following Table 2, it is possible to improve accuracy in the ink discharging position.

TABLE 2

| Head temperature (T) | P1 | P2 | P3 |
|---|---|---|---|
| T ≦ 25° C. | 0.80 | 1.0 | 1.8 |
| 25° C. < T ≦ 30° C. | 0.70 | 1.0 | 1.8 |
| 30° C. < T ≦ 35° C. | 0.40 | 1.0 | 1.8 |
| 35° C. < T ≦ 40° C. | 0.35 | 1.0 | 1.8 |
| 40° C. < T ≦ 45° C. | 0.25 | 1.0 | 1.8 |
| 45° C. < T ≦ 50° C. | 0.20 | 1.0 | 1.8 |
| 50° C. < T ≦ 55° C. | 0.10 | 1.0 | 1.8 |
| 55° C. < T | 0.00 | 1.0 | 1.8 |

According to the second embodiment, when driving the recording head with double-pulse control, by changing the pulse width in accordance with the head temperature within a range wider than in the first embodiment, it is possible to improve accuracy in the ink discharging position in the direction of arrangement of ink discharging nozzles.

Although in the above-described embodiments, a Di sensor provided on the substrate is used, the present invention is not limited to such an approach. For example, any other means, such as an aluminum sensor or the like, may be used. Furthermore, instead of directly detecting the temperature, for example, temperature estimation means which estimates the head temperature by counting continuously applied driving pulses may be used instead of the temperature detection means.

Although in the above-described embodiments, a double-pulse signal is used as the driving signal, a signal including a plurality of pre-pulses may also be used. Furthermore, a single-pulse signal may be used, although such a signal is inferior to a double-pulse signal from the viewpoint of ease of changes in the power of bubble generation.

Although in the foregoing embodiments, a description has been provided assuming that the liquid droplet discharged from the recording head is ink, and the liquid stored in the ink tank is ink, the liquid is not limited to ink. For example, a substance, such as a processing liquid to be discharged onto the recording medium in order to improve the fixing property, the water resisting property, or the quality of the recorded image, may be accommodated within the ink tank.

According to the above-described embodiments, by using an ink-jet recording method which includes means for generating thermal energy (for example, electrothermal transducers, a laser beam, or the like) as energy to be utilized for causing ink discharge, and which causes a change in the state of ink by the thermal energy, high-density recording and very precise recording can be achieved.

Typical configuration and principle of such an ink-jet recording method to be preferably used are disclosed, for example, in U.S. Pat. Nos. 4,723,129 and 4,740,796. The disclosed method can be applied to both of so-called on-demand type and continuous type. Particularly, the on-demand type is effective because by applying at least one driving signal for causing a rapid temperature rise exceeding a temperature region to cause only nucleate boiling to an electrothermal transducer disposed so as to face a sheet holding a liquid (ink), or a liquid channel in accordance with recording information, thermal energy is generated in the electrothermal transducer to cause film boiling on the heat operating surface of the recording head and to form a bubble within the liquid (ink) corresponding to the driving signal. By discharging the liquid (ink) form the discharging opening due to the growth and contraction of the bubble, at least one droplet is formed. It is preferable to provide the driving signal in the form of a pulse because the bubble can be instantaneously and appropriately grown and contracted and the discharging of the liquid (ink) with a high response speed can be achieved.

A pulse-shaped driving signal such as ones described in U.S. Pat. Nos. 4,463,359 and 4,345,262 is suitable. By adopting conditions described in U.S. Pat. No. 4,313,124 relating to the rate of temperature rise of the heat operating surface, more excellent recording can be performed.

In addition to the configuration of combining discharging ports, a liquid channel and electrothermal transducers (a linear liquid channel or an orthogonal liquid channel) as disclosed in the above-described patent applications, configurations described in U.S. Pat. Nos. 4,558,333 and 4,459,600 in which a heat operating unit is disposed at a bending region may also be adopted for the recording head of the present invention. In addition, the present invention is also effective for a configuration disclosed in Japanese Patent Laid-Open Application (Kokai) No. 59-123670 (1984) in which a common slit is used as a discharging port for a plurality of electrothermal transducers, and for a configuration disclosed in Japanese Patent Laid-Open Application (Kokai) No. 59-138461 (1984) in which an aperture for absorbing the pressure wave of thermal energy is used as a discharging port.

As a full-line-type recording head having a length corresponding to the maximum width of a recording medium which can be recorded by the recording apparatus, a configuration of covering the length by a combination of a plurality of recording heads, or a single integrally formed recording head maybe used.

Furthermore, a cartridge-type recoding head having an ink tank provided as one body therewith or an exchangeable chip-type recording head capable of electric connection to the main body of the apparatus and ink supply from the main body of the apparatus by being mounted on the main body of the apparatus may also be used.

The addition of recovery means, preliminary means and the like to the recording head is preferable because the recording operation can be more stabilized. More specifically, these means include capping means, cleaning means, and pressurizing or sectioning means for the recording head, and preliminary heating means for performing heating using an electrothermal transducer, a heating element other than the electrothermal transducer, or a combination of these elements. Provision of a preliminary discharging mode for performing discharging different from recording is also effective for performing stable recording.

Furthermore, the present invention may also be applied to a recording mode using a single color, such as black or the like, an integrally formed recording head, a combination of a plurality of recording heads, and a recording apparatus which has a least one of a recording mode using a plurality of different colors and a recording mode of obtaining a full-color image by mixing colors.

Although in the foregoing embodiments, a description has been provided illustrating ink in the form of a liquid, ink which is solidified at a temperature equal to or lower than the room temperature and is softened or liquefied at the room temperature may also be used. In the ink-jet method, ink itself is generally subjected to temperature control within a range of 30° C.–70° C. so that the viscosity of the ink is within a range of stable discharge. Hence, ink which is liquefied when providing a recording signal may also be used.

Furthermore, in order to prevent temperature rise due to thermal energy by using the energy for liquefied ink from a solidified state or to prevent evaporation of ink, ink which is usually solid and is liquefied by being heated may also be used. Anyway, the present invention can also be applied to a case in which ink is liquefied by providing thermal energy corresponding to a recording signal and the liquefied ink is discharged, and to a case of using ink which is liquefied when it reaches a recording medium. In the present invention, the above-described film boiling method is most effective for the above-described ink.

The present invention may be applied to an image output terminal of an information processing apparatus, such as a computer or the like, which is provided as one body with or separated from the information processing apparatus, a copier combined with a reader and the like, a facsimile apparatus having a transmission/reception function, and the like.

The present invention may be applied to a system comprising a plurality of apparatuses (such as a host computer, an interface apparatus, a reader, a printer and the like), or to an apparatus comprising a single unit (such as a copier, a facsimile apparatus or the like).

The objects of the present invention may, of course, also be achieved by supplying a system or an apparatus with a storage medium (or a recording medium) storing program codes of software for realizing the functions of the above-described embodiments, and reading and executing the program codes stored in the storage medium by means of a computer (or a CPU (central processing unit) or an MPU) of the system or the apparatus. In such a case, the program codes themselves read from the storage medium realize the functions of the above-described embodiments, so that the storage medium storing the program codes constitutes the present invention.

The present invention may, of course, be applied not only to a case in which the functions of the above-described embodiments are realized by executing program codes read by a computer, but also to a case in which an OS (operating system) or the like operating in a computer executes a part or the entirety of actual processing and the functions of the above-described embodiments are realized by the processing.

The present invention may, of course, be applied to a case in which, after writing program codes read from a storage medium into a memory provided in a function expanding card inserted into a computer or in a function expanding unit connected to the computer, a CPU or the like provided in the function expanding card or the function expanding unit performs a part or the entirety of actual processing, and the functions of the above-described embodiments are realized by the processing.

As described above, according to the present invention, in a discharging method in which a bubble is generated by supplying ink with thermal energy and the generated bubble is caused to communicate with the atmospheric air, by controlling the driving signal so that a part of the liquid to be discharged falls even if the temperature of the head changes, the ink discharging direction can be stabilized.

It is thereby possible to record an image by causing ink to adhere to a correct position on a recording medium with excellent accuracy. Accordingly, it is possible to record a high-quality image which does not have unevenness in density, and the like.

The individual components shown in outline or designated by blocks in the drawings are all well known in the liquid-discharge control method and liquid discharging apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A liquid-discharge control method, in which a bubble is generated by supplying a liquid with thermal energy by driving one of electrothermal transducers, and the liquid is displaced and discharged from a corresponding one of nozzles by causing the bubble to communicate with the atmospheric air, said method comprising:

a detection step of detecting a temperature of a head where the electrothermal transducers and the nozzles are provided;

an adjusting step of adjusting an energy of a driving signal for driving the electrothermal transducer so that a part of the liquid being displaced returns to the electrothermal transducer, based on the temperature detected in said detection step; and a recording step of discharging the liquid by driving the head using the driving signal having the adjusted energy adjusted in said adjusting step.

2. A liquid-discharge control method according to claim 1, wherein the driving signal is a double-pulse signal including a pre-pulse for heating the liquid to a degree of not generating the bubble, a main pulse for generating the bubble for discharging the liquid, and a time period of pause between the two pulses.

3. A liquid-discharge control method according to claim 2, wherein the energy of the driving signal is adjusted by adjusting energy of the pre-pulse.

4. A liquid-discharge control method according to claim 3, wherein a plurality of nozzle columns where a plurality of the nozzles are arranged are provided.

5. A liquid-discharge control method according to claim 4, wherein the plurality of nozzle columns are arranged to be spaced in a scanning direction of the head, and wherein the plurality of nozzles constituting each of the plurality of nozzle columns are arranged in a direction crossing the scanning direction.

6. A liquid-discharge control method according to claim 1, wherein the liquid is ink, and wherein recording is performed by causing the discharged ink to adhere onto a recording medium.

7. A liquid-discharge control method according to claim 6, wherein in said adjusting step, in order to make adhering positions of the ink discharged from the head with respect to a direction of arrangement of a plurality of nozzle columns on the recording medium substantially constant, an appropriate pulse energy is determined by referring to a table storing a relationship between the temperature of the head and a signal energy corresponding to the head temperature.

8. A liquid-discharge control method according to claim 6, wherein in said adjusting step, in order to make adhering positions of the ink discharged from the head with respect to a direction of arrangement of a plurality of nozzles constituting each of a plurality of nozzle columns on the recording medium substantially constant, an appropriate pulse energy is determined by referring to a table storing a relationship between the temperature of the head and a pulse energy corresponding to the head temperature.

9. A liquid-discharge control method according to claim 1, wherein the energy of the driving signal corresponds to the width of the driving signal.

10. A liquid discharging apparatus comprising a head, which comprises electrothermal transducers, each for generating a bubble by supplying a liquid with thermal energy, and nozzles for discharging the liquid, for causing the bubble to displace and discharge the liquid by causing the generated bubble to communicate with the atmospheric air, said apparatus comprising:

detection means for detecting a temperature of the head;

adjustment means for adjusting an energy of a driving signal for driving one of the electrothermal transducers so that a part of the liquid being displaced returns to the electrothermal transducer, based on the temperature detected by said detection means; and recording means for discharging the liquid by driving the head using the driving signal having the adjusted energy adjusted by the adjustment means.

11. A liquid discharging apparatus according to claim 10, wherein said detection means comprises a diode sensor for measuring the temperature of the head.

12. A liquid discharging apparatus according to claim 10, further comprising scanning means for causing the head to perform reciprocating scanning.

13. A liquid discharging apparatus according to claim 10, wherein the driving signal is a double-pulse signal including a pre-pulse for heating the liquid to a degree of not generating the bubble, a main pulse for generating the bubble for discharging the liquid, and a time period of pause between the two pulses.

14. A liquid discharging apparatus according to claim 13, wherein the energy of the driving signal is adjusted by adjusting energy of the pre-pulse.

15. A liquid discharging apparatus according to claim 10, wherein a plurality of nozzle columns where a plurality of nozzles are arranged are provided.

16. A liquid discharging apparatus according to claim 15, wherein the plurality of nozzle columns are arranged to be spaced in a scanning direction of scanning means, and wherein the plurality of nozzles constituting each of the plurality of nozzle columns are arranged in a direction crossing the scanning direction.

17. A liquid discharging apparatus according to claim 10, wherein ink is the liquid, and wherein recording is performed by causing the discharged ink to adhere onto a recording medium.

18. A liquid discharging apparatus according to claim 17, wherein said adjustment means comprises storage means for storing a table representing a relationship between the temperature of the head and a pulse energy corresponding to the head temperature, in order to make adhering positions of the ink discharged from the head with respect to a scanning direction on the recording medium substantially constant, and determination means for determining an appropriate pulse energy by referring to the table stored in said storage means.

19. A liquid discharging apparatus according to claim 17, wherein said adjustment means comprises storage means for storing a table representing a relationship between the temperature of the head and a pulse energy corresponding to the head temperature, in order to stabilize adhering positions of the ink discharged from the head with respect to a direction of arrangement of a plurality of nozzles constituting each of a plurality of nozzle columns on the recording medium, and determination means for determining an appropriate pulse energy by referring to the table stored in said storage means.

20. A liquid discharging apparatus according to claim 12, wherein the adjustment of the energy of the driving signal by said adjustment means is performed at every recording performed by one scanning operation by the head caused by said scanning means.

21. A liquid discharging apparatus according to claim 10, wherein the energy of the driving signal corresponds to the width of the driving signal.

* * * * *

UNITED STATES PATENT AND TRADEMARK OFFICE

CERTIFICATE OF CORRECTION

PATENT NO. : 6,474,763 B1
DATED : November 5, 2002
INVENTOR(S) : Murakami et al.

It is certified that error appears in the above-identified patent and that said Letters Patent is hereby corrected as shown below:

Column 8,
Line 18, “(now” should read -- (not --.
Line 41, “an” should read -- a --.

Column 12,
Line 29, “form” should read -- from --.

Column 13,
Line 26, “example,” should read -- example, a --.
Line 65, “form” should read -- from --.

Column 14,
Line 31, “maybe” should read -- may be --.
Line 32, “recoding” should read -- recording --.
Line 42, “sectioning” should read -- suctioning --.
Line 53, “has a” should read -- has at --.
Line 67, “liquefied” should read -- liquefying --.

Signed and Sealed this

Eighth Day of July, 2003

JAMES E. ROGAN
*Director of the United States Patent and Trademark Office*